US006656228B1

(12) United States Patent
Sherwin et al.

(10) Patent No.: US 6,656,228 B1
(45) Date of Patent: Dec. 2, 2003

(54) COMPOSITION AND USE THEREOF FOR INK JET PRINTING

(75) Inventors: Alison Sherwin, Blackley (GB); John Reginald Provost, Eccleston, Near Chorley (GB); William Albert Fern, Blackley (GB)

(73) Assignee: Avecia Limited, Blackley (GB)

( * ) Notice: Subject to any disclaimer, the term of this patent is extended or adjusted under 35 U.S.C. 154(b) by 0 days.

(21) Appl. No.: 09/674,271

(22) PCT Filed: Apr. 20, 1999

(86) PCT No.: PCT/GB99/01203

§ 371 (c)(1),
(2), (4) Date: Jan. 29, 2001

(87) PCT Pub. No.: WO99/55955

PCT Pub. Date: Nov. 4, 1999

(30) Foreign Application Priority Data

Apr. 28, 1998 (GB) ..... 9809058

(51) Int. Cl.[7] ..... D06P 1/39

(52) U.S. Cl. ..... 8/188; 8/115.51; 8/115.6; 8/181; 8/445; 8/455; 8/480; 8/485; 8/495; 8/542; 8/543

(58) Field of Search ..... 8/115.51, 115.6, 8/181, 188, 445, 455, 480, 485, 495, 542, 543

(56) References Cited

U.S. PATENT DOCUMENTS 4,215,992 A * 8/1980 Sato et al. ..... 8/445

5,512,061 A * 4/1996 Von Der Eltz et al. ..... 8/480

FOREIGN PATENT DOCUMENTS

| | | |
|---|---|---|
| DE | 195 27 100 | 1/1997 |
| EP | 534 660 | 3/1993 |
| EP | 624 682 | 11/1994 |

OTHER PUBLICATIONS

Database WPI, Section Ch, Week 8647, Derwent Publication Ltd. Class A97, AN 86–308908, XP002110804, & JP 61 228100, Oct. 11, 1986.

Database WPI, Section Ch, Week 8908, Derwent Publication Ltd. Class E19, AN 89–057358, XP002110805, & JP 01 009279, Jan. 12, 1989.

Database WPI, Section Ch, Week 8710, Derwent Publication Ltd. Class E19, AN 87–067597, XP002110806, & JP 62 019483, Jan. 28, 1987.

* cited by examiner

*Primary Examiner*—Charles Boyer
(74) *Attorney, Agent, or Firm*—Pillsbury Winthrop LLP

(57) ABSTRACT

A composition comprising:

(a) a cationic substance;

(b) an acid generator; and (c) an alkyl or a hydroxyalkyl substituted starch.

Also claimed is a polyamide textile material treated with the composition, a method for ink jet printing onto a polyamide textile material which has been treated with the composition and a polyamide material printed using the method.

14 Claims, No Drawings

COMPOSITION AND USE THEREOF FOR INK JET PRINTING

The present invention relates to a composition suitable for application to polyamide textile materials, to a polyamide textile material treated with the composition, to an ink jet printing method, and to a polyamide textile material coloured using the method.

The printing of textiles is conventionally carried out by screen or roller printing using gravure engraved cylinders. The design to be printed has to be engraved on to a cylinder and each individual colour in a design requires the application of a separate screen with a colour pre-mixed to the required shade. This is a long and slow process and it can take many months for a textile design to appear as a printed textile. Consequently, there is a demand for a printing process which enables new designs to be printed onto a textile quickly for proofing purposes and for small production runs. Ink jet printing of textiles offers the potential to transfer a design to a textile much faster than traditional textile printing methods.

The prints prepared using ink jet printing are required to meet many demanding criteria, for example the prints are preferably bright, have a high water-fastness and good light-fastness. In addition, the ink jet printing process is preferably capable of producing prints which exhibit a colour gamut comparable to that obtained using conventional printing methods.

PCT application no. GB97/03423 discloses a method of ink jet printing wherein the colour gamut achievable using ink jet printing onto, inter alia, cellulosic textiles is increased by using up to eight reactive dyes.

U.S. Pat. No. 5,645,631 discloses a ink jet printing using inks containing a reactive dye onto a cellulosic material which has a specific fibre length and moisture regain.

U.S. Pat. No. 5,698,478 discloses ink jet printing using inks containing a reactive dye onto a cellulosic textile material containing 0.1 to 50% by weight of a cationic substance, 0.01 to 5% by weight of an alkaline substance and 0.01 to 20% by weight of the ammonium salt of a polyvalent acid.

The above ink jet printing methods fix the dyes by means of a covalent bond formed between cellulosic textiles and reactive group(s) present in the dyes by heating the printed textile under alkaline conditions.

We have found that when reactive dyes are applied to polyamide textiles, especially silk, using ink jet printing followed by fixing the dyes by heating under alkaline conditions, the resulting prints are often dull and exhibit a poor colour gamut compared to prints obtained using conventional printing techniques.

U.S. Pat. No. 5,594,485 discloses ink jet printing of acid dyes onto silk wherein the silk has a specified moisture content. However, the colour gamut available through ink jet printing of acid dyes is very limited compared to that obtained using conventional printing methods.

There is, therefore, a need for an ink jet printing method which provides prints on polyamide textiles which exhibit a brightness and colour gamut comparable to that obtained by printing such materials using conventional printing techniques.

We have found that the brightness and colour gamut of prints obtained by ink jet printing with inks containing various classes of anionic dyes onto a polyamide textile material is improved by applying a pre-treatment composition to the polyamide material.

According to a first aspect of the present invention there is provided a first composition comprising:

(a) a cationic substance;

(b) an acid generator; and (c) an alkyl or a hydroxyalkyl substituted starch.

Preferably the composition is free from alkaline materials.

Preferably the composition comprises:

from 0.5 to 99.5, more preferably from 5 to 80 and especially from 10 to 80 parts of component (a);

from 0.1 to 60, more preferably from 0.5 to 50 and especially from 2 to 45 parts of component (b);

from 0.1 to 99.5, more preferably from 0.5 to 80 and especially from 8 to 70 parts of component (c);

wherein all parts are by weight and the sum of the parts of components (a)+(b)+(c)=100.

The cationic substance is preferably a cationic polymer or a quaternary ammonium compound.

Preferred cationic polymers are polymers which carry a quaternary ammonium group. The cationic polymer is preferably a copolymer formed by polymerising a monomer containing a quaternary ammonium salt, with one or more monomers selected from vinyl pyrrolidone, acrylamide, allylamine and ethyleneimine.

Especially preferred cationic polymers are:

(a) cationic polyethylenimines;

(b) cationic polymers as described in U.S. Pat. No. 5,698,478, cols. 4 to 6, the contents of which are incorporated herein by reference thereto; and (c) dicyanamide/phenol—formaldehyde/ammonium chloride condensate, for example the 50% aqueous solution available as MATEXIL™ FC-PN from ICI Limited.

Preferred quaternary ammonium compounds are of the Formula (1):

Formula (1)

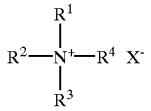

wherein:

$R^1$, $R^2$ and $R^3$ are each independently selected from H, optionally substituted $C_{1-20}$-alkyl and optionally substituted $C_{2-20}$-alkenyl; $R^4$ is optionally substituted $C_{1-20}$-alkyl or optionally substituted $C_{2-20}$-alkenyl; and $X^-$ is an anion.

Preferably $R^1$ and $R^2$ are each independently selected from $C_{1-20}$-alkyl or $C_{2-20}$-alkenyl, more preferably $C_{1-4}$-alkyl, especially methyl.

$R^3$ and $R^4$ are preferably each independently $C_{5-20}$-alkyl or $C_{5-20}$-alkenyl, especially $C_{16-20}$-alkyl or $C_{16-20}$-alkenyl and more especially $C_{18}$-alkyl.

When any of the groups $R^1$, $R^2$, $R^3$ or $R^4$ is alkyl or alkenyl it may be branched or, preferably, straight chain.

Preferred alkyl groups represented by $R^1$, $R^2$, $R^3$ and $R^4$ are of formula $—(CH_2)_nCH_3$ wherein n has a value of from 0 to 19.

It is preferred that $R^3$ and $R^4$ are each independently of Formula $—(CH_2)_nCH_3$ wherein n is from 9 to 19, especially 15 to 19, more especially 17.

Preferably $R^1$ and $R^2$ are identical. In one preferred embodiment $R^2$, $R^3$ and $R^4$ are identical.

The nature of the anion represented by $X^-$ is not believed to be critical. However, preferred anions include ½ ($SO_4^{2-}$) and halide, and especially $Cl^-$.

The compounds of Formula (1) preferably contain 30 or more, more preferably 30 to 50, especially 32 to 48 and more especially 36 to 40 carbon atoms.

Preferred compounds of Formula (1) include tetraoctylammonium salts, tridecyl ammonium salts, tridodecylammonium salts, tetradecylammonium salts, tridecylmethyl ammonium salts, tridodecylmethylammonium salts, distearyldiethylammonium salts, distearyldipropylammonium salts, more preferably distearyldimethylammonium salts, and especially the preceding quaternary ammonium compounds with a chloride, sulphate or bromide anion. An especially preferred compound of Formula (1) is distearyl dimethylammonium chloride.

Component (a) of the composition is preferably a quaternary ammonium compound because we have found that the presence of such a compound in the composition gives prints which exhibit a very high colour yield.

The acid generator (component (b)) is preferably an organic or inorganic acid, and more preferably an organic acid, or a salt thereof. The organic acid may be monobasic or polybasic. It is especially preferred that the acid generator is an organic polybasic acid, or a salt thereof.

Preferred organic monobasic acids comprise an aromatic or aliphatic group substituted with a group selected from —COOH, —$PO_3H_2$ and —$SO_3H$, especially —COOH. Preferred aliphatic monobasic acids comprise an optionally substituted alkyl group which carries an acid group, preferably a —COOH group. The alkyl group is preferably $C_{1-12}$-alkyl, and more preferably $C_{1-6}$-alkyl. When the aliphatic monobasic acid is substituted the substituent(s) is/are preferably selected from —OH and —$NH_2$. Examples of preferred aliphatic monobasic acids include acetic acid, propionic acid, butyric acid, isobutyric acid, pentanoic acid, 2,2-dimethylpropanoic acid, glycolic acid, lactic acid and glyceric acid.

Preferred aromatic monobasic acids comprise an aromatic group substituted with —COOH, —$SO_3H$ or —$PO_3H_2$, more preferably —COOH. Preferred aromatic groups are phenyl, naphthyl, pyridinyl, furanyl, thiofuranyl or benzyl each of which is optionally substituted. More preferably the aromatic group is optionally substituted phenyl or optionally substituted pyridinyl.

Preferred examples of monobasic aromatic acids include nicotinic acid, isonicotinic acid, salicylic acid, anisic acid, vanillic acid and gallic acid.

Preferred organic polybasic acids include aromatic polybasic acids and aliphatic polybasic acids.

Preferred aromatic polybasic acids are optionally substituted benzene, pyridine or naphthylene groups which carry two or more groups selected from —$SO_3H$, —COOH and —$PO_3H_2$. It is especially preferred that the aromatic polybasic acid carries 2 or 3 acid groups selected from —$SO_3H$ and —COOH.

The optional substituents which may be present on the aromatic groups of aromatic monobasic acids and aromatic polybasic acids are preferably selected from halogen (especially F or Cl); —$NO_2$; —$CF_3$; —CN; a $C_{1-6}$-alkyl, $C_{2-6}$-alkenyl, $C_{5-8}$-cycloalkyl or $C_{1-6}$-alkoxy group optionally substituted by —OH, —$NH_2$, —$NO_2$ or halogen; a group of the formula —$SR^5$, or —$COOR^5$ wherein $R^5$ is H, $C_{1-4}$-alkyl, $C_{5-8}$-cycloalkyl or phenyl; and groups of the formula —$OR^6$, —$COR^6$; —$NR^6R^7$, —$SO_2NR^6R^7$, —$SOR^6$, —$SO_2R^6$, —$NR^6COR^7$, —$CONR^6R^7$, or —$OCOR^6$, wherein $R^6$ and $R^7$ each independently represent H, $C_{1-4}$alkyl, $C_{5-8}$-cycloalkyl, phenyl or $R^6$ and $R^7$ together with the nitrogen to which they are attached form a 5 or 6 membered ring, for example piperazine or morpholine.

Especially preferred aromatic polybasic acids include for example phthalic acid, isophthalic acid and terephthalic acid.

Preferred aliphatic polybasic acids contain up to 20 carbon atoms. The aliphatic polybasic acids preferably comprise an aliphatic group which carries 2 to 8, more preferably 2 to 6, especially 2 or 3 and more especially 2, groups selected from —$SO_3H$, —COOH and —$PO_3H_2$. The aliphatic polybasic acid may be saturated or unsaturated.

Preferred acid groups in the aliphatic polybasic acids are selected from —COOH and —$SO_3H$, and especially —COOH.

Preferred saturated aliphatic groups are alkanes and preferred unsaturated groups are alkenes and alkynes. The alkane, alkene and alkyne groups may be straight chain, branched chain or cyclic and are optionally interrupted by one or more groups or heteroatoms, for example —O—, —S—, —$NR^8$—, optionally substituted phenylene, piperazinylene and —C(O)—, wherein $R^1$ is H, optionally substituted alkyl, or optionally substituted phenyl.

The alkane and alkene groups optionally contain further substituents, preferably selected from —SH, or —$OR^6$, wherein $R^6$ is as hereinbefore defined, more preferably —OH.

When the alkane, alkene or alkyne group is interrupted by an optionally substituted phenylene group, it is preferred that the optional substituents on the phenylene are selected from —OH, —$NO_2$, —$NH_2$, $C_{1-4}$-alkyl, —SH, —COOH and —$SO_3H$.

Preferably $R^8$ is H, $C_{1-4}$-alkyl, $C_{1-4}$-alkyl substituted by —OH, phenyl or phenyl substituted by —OH, —$NH_2$, —$NO_2$, $C_{1-4}$-alkyl or $C_{1-4}$-alkyl substituted by —OH.

Especially preferred aliphatic polybasic acids are dicarboxylic acids of the Formula (2):

$$\text{HOOC—W—COOH} \tag{2}$$

wherein:

W is an optionally substituted, optionally interrupted alkylene, alkenylene or alkynylene group.

When W is a substituted alkenylene group, it is preferably substituted by —OH.

Preferred groups which may interrupt W are —O—, —S—, —NH—, —C(O)—and phenylene optionally substituted by —OH, —$NH_2$, —SH, —COOH or —$SO_3H$.

Examples of optionally substituted alkenylene and alkynylene groups include —CH═CH—,—$CH_2$CH═CH—, —$CH_2$CH═CH$CH_2$—, —C═C—and —$CH_2$C═—$CCH_2$—.

Preferred interrupted alkylene groups are of the formula:

$$—C_2H_{2a}—L—C_bH_{2b}—$$

wherein:

L is —O—, —S—, —NH—, —C(O)—or phenylene optionally substituted by —OH, —$NH_2$, —SH, —COOH or —$SO_3H$;

a is an integer from 1 to 17; and b is an integer from 1 to 17, provided that $(a+b) \leqq 18$.

Examples of preferred groups represented by L include —$CH_2$—O—$CH_2$—, —$CH_2$—$C_6H_4$—$CH_2$—, —$CH_2C_6H_4CH_2$—, —$CH_2$C(O)$CH_2$—, and —$CH_2SCH_2$—.

Preferably W is an optionally substituted straight or branched chain alkylene group. When W is a substituted alkylene group it is preferably substituted by one or more —OH groups. Examples of such groups include —CH(OH)—, —CH(OH)CH(OH)—and —$CH_2$CH(OH)—.

It is especially preferred that W is a group of the formula —$C_mH_{2m}$—, wherein m is 1 to 18, preferably 1 to 10 and especially 1 to 8.

Preferred dicarboxylic acids of the Formula (2) when W is an alkenylene group include for example, maleic acid, fumaric acid, citraconic acid and itaconic acid.

Preferred dicarboxylic acids of the Formula (2) when W is alkylene substituted by —OH include for example, malic acid, tartronic acid, tartaric acid and mucic acid.

Preferred dicarboxylic acids of the Formula (2) when W is group of the formula —$C_mH_{2m}$—, wherein m is as hereinbefore defined include, for example, malonic acid, succinic acid, glutaric acid, adipic acid, pimelic acid, suberic acid, azelaic acid and sebacic acid and dodecanedioc acid.

Preferred dicarboxylic acids of the Formula (2) when W is a cyclic alkylene or alkenylene group include, for example, cyclohexene dicarboxylic acid and cyclohexane dicarboxylic acid.

Further examples of aliphatic polybasic acids suitable for use in the present invention include, but are not limited to, tribasic acids, especially citric acid, and dibasic acids, for example oxalic acid.

When the acid generator is present as a salt preferred salts include sodium, lithium and ammonium salts and salts with volatile amines. It is preferred, however, that the acid generator is in free acid form. Preferably the acid generator is colourless.

Preferred acid generators are selected from nicotinic acid, citric acid, tartaric acid and malonic acid, more especially citric acid and nicotinic acid.

When component (c) is an alkyl-substituted starch, the starch is preferably substituted by $C_{1-6}$-alkyl, more preferably $C_{1-4}$-alkyl.

When component (c) is hydroxyalkyl substituted starch the starch is preferably substituted by $C_{2-4}$-hydroxyalkyl, more preferably by hydroxyethyl or hydroxypropyl groups.

Preferably the starch is corn starch, wheat starch, rice starch, potato starch or tapioca starch, more preferably potato starch or tapioca starch. The starch is preferably substituted at the free hydroxyl groups of the D-glucopyranose rings of the starch. The degree of substitution on the starch is 0.05 to 3, more preferably 0.05 to 2 and especially 0.05 to 0.5 per D-glucopyranose ring.

An especially preferred component (c) is hydroxypropyl or hydroxyethyl substituted tapioca starch. More especially component (c) is hydroxypropyl substituted tapioca starch, for example Solvitose WB available from Avebe, Holland.

The starch may by substituted using known methods. For example it may be hydroxyethylated or hydroxypropylated by heating a slurry of granular starch in an lower aliphatic alcohol (preferably a $C_{1-3}$-alchohol) with a Group I or II metal hydroxide (preferably NaOH) in the presence of a small amount of water (up to 10% by weight) and reacting the alkaline slurry with ethylene oxide or propylene oxide at a temperature of 40 to 120° C.

The starch may be alkylated by heating an alkaline aqueous suspension of starch with an appropriate alkylchloride. The reaction is preferably performed in the presence of an alkali metal chloride such as NaCl.

It is preferred that the composition according to the first aspect of the invention is used in a liquid medium because this helps to achieve a uniform coating and good impregnation when the composition is applied to a polyamide textile material.

According to a second aspect of the present invention there is provided a composition comprising the composition according to the first aspect of the present invention and a liquid medium.

Preferably the liquid medium is an aqueous medium, more preferably water or a mixture of water and one or more water-soluble organic solvent(s).

In view of the foregoing preferences an especially preferred composition according to the second aspect of the present invention comprises:

(a) from 0.1 to 20, more preferably from 0.5 to 5 parts of a quaternary ammonium compound;

(b) from 0.05 to 40, more preferably from 0.1 to 30 parts of an organic acid (preferably an organic polybasic acid), or a salt thereof;

(c) from 0.05 to 30, more preferably 0.1 to 10 parts of an alkyl or hydroxyalkyl substituted starch; and (d) from 30 to 95, more preferably 40 to 90 parts of an aqueous medium;

wherein all parts are by weight and the sum of the parts of component (a)+(b)+(c)+(d)=100.

Preferably the pH of the second composition is in the range of from 2 to 7, more preferably from 3 to 6 and especially from 3.5 to 5.5.

The viscosity of the second composition at 25° C is preferably from 15 to 60, more preferably from 15 to 50, especially from 25 to 45 and more especially from 40 to 50 cP.

The first composition is preferably dispersed or dissolved in the liquid medium to give the second composition.

According to a third aspect of the present invention there is provided a polyamide textile material treated with a composition according to the first or second aspect of the present invention.

Preferably the polyamide textile material is a natural or synthetic polyamide textile material, a blend of natural and synthetic polyamide textile materials or a blend of a polyamide with one or more other synthetic textile materials which is not a polyamide textile material, for example a polyester (for example Lycra™ available from Dupont). Preferred natural polyamide textile materials include for example, wool, silk, hair and hair based textiles such as cashmir. Preferred synthetic polyamide textile materials include Nylon 6, Nylon 6,6 and Nylon 11. It is especially preferred that the polyamide textile material is silk.

Preferred compositions used to treat the polyamide textile material are as defined in the first and second aspects of the present invention. It is preferred however, that the polyamide material is treated with a composition according to the second aspect of the present invention.

The polyamide textile material may be treated with the composition according to the second aspect of the invention using any convenient method, for example by dip coating, roller coating, K-bar coating, printing, ink jet printing or by padding the surface of the material with the composition. It is especially preferred that the material is treated by padding the composition onto the material.

According to a fourth aspect of the present invention there is provided a method for the coloration of a polyamide textile material comprising the steps:

i) treating the polyamide textile material with a composition according to the second aspect of the present invention;

ii) applying by means of an ink jet printer an ink composition comprising a liquid medium and a water-soluble anionic dye, or a salt thereof, to the product of step i); and iii) heating the product of step ii) at a temperature of from 50° C to 250° C.

The product of step i) is conveniently a treated polyamide textile material according to the second aspect of the present invention. It is especially preferred that the polyamide material is silk.

The composition applied to the material in step i) is preferably an aqueous composition as hereinbefore defined in the second aspect of the present invention.

The material in stage i) is preferably treated by padding the composition defined in the second aspect of the invention onto the material.

Preferably the product of step i) is dried before step ii) is performed. Drying may be performed using any convenient method, for example by squeezing the material between rollers or by heating the material, for example by exposure to hot air or direct heating, for example by infra-red radiation, or micro-wave radiation, preferably so that the temperature of the material does not exceed 100° C.

Preferably the ink composition used in step ii) of the present method comprises a water-soluble anionic dye and a liquid medium.

Preferred water-soluble anionic dyes are water-soluble anionic direct, reactive and acid dyes, for example azo, bis azo, tris azo and phthalocyanine dyes which preferably contain one, or more preferably two or more, groups selected from —COOH, —$SO_3H$ and $PO_3H_2$ in the free acid or salt form.

Preferred direct dyes include for example Cl Direct Black 9, 17, 19, 22, 32, 51, 56, 62, 69, 77, 80, 91 94, 97, 108, 112, 113, 114, 117, 118, 121, 122, 125, 132, 146, 154, 166, 168, 173, 195 and 199; Cl Direct Blue 1, 10, 15, 22, 25, 55, 67 ,68, 71, 76, 77, 78, 80, 84, 86, 87, 90, 98, 106, 108, 109, 151, 156, 158, 159, 160, 168, 189, 192, 193, 194, 199, 200, 201, 202, 203, 207, 211, 213, 214, 218, 225, 229, 236, 237, 244, 248, 249, 251, 252, 264, 270, 280, 288, 289, 291 and 307; Cl Direct Green 26, 27, 28, 29, 30, 31, 33, 34, 59, 63, 65, 66, 67, 68, 74, 80, 85, 89; Cl Direct Yellow 8, 9, 11, 12, 27, 28, 29, 33, 35, 39, 41, 44, 50, 53, 58, 59, 68, 86, 87, 93, 95, 96, 98, 100, 106, 108, 109, 110, 130, 132, 142, and 173; Cl Direct Violet 106 and 107; Cl Direct Orange 6, 15, 18, 26 29, 34, 37, 39, 40, 41, 46, 49, 51, 57, 62, 71, 105, 107 and 115; Cl Direct Red 2, 4, 9, 23, 26, 31 39, 62, 63, 72, 75, 76, 79, 80, 81, 83, 84, 89, 92, 95, 111, 173, 184, 207, 211, 212, 214, 218, 221, 223, 224, 225, 226, 227, 232, 233, 240, 241, 242, 243 and 247.

Preferred acid dyes include, Cl Acid Yellow 17, 19, 23, 25, 39, 40, 42, 44, 49, 50, 61, 64, 76, 79, 110, 127, 135, 143, 151, 159, 169, 174, 190, 195, 196, 197, 199, 218, 219, 222, 227; Cl Acid Orange 3, 19, 24, 28:1, 33, 43, 45, 47, 51, 67, 94, 116, 127, 138, 145, 156; Cl Acid Red 35, 42, 52, 57, 62, 80, 82, 111, 114, 118, 119, 127, 128, 131, 143, 151, 154, 158, 249, 257, 261, 263, 266, 299, 301, 336, 337, 361, 396, 397; Cl Acid Violet 5, 34, 43, 47, 48, 90, 103, 126; Cl Acid Blue 9, 25, 40, 41, 62, 72, 76, 78, 80, 82, 90, 106, 112, 112, 113, 120, 127:1, 129, 138, 143, 158, 175, 181, 205, 207, 220, 221, 230, 232, 247, 258, 260, 264, 271, 277, 278, 278, 279, 280, 288, 290, 326; Acid Green 16, 17, 19, 20, 25, 28, 40, 41, 71; Cl Acid Black 7, 24, 29, 48, 52:1.

Preferred reactive dyes include Cl Reactive Yellow 2, 3, 3:1, 13, 14, 15, 17, 18, 23, 24, 25, 26, 27, 29, 35, 37, 41, 42, 49, 50, 52, 54, 55, 57, 58, 63, 64, 75, 76, 77, 79, 81, 82, 83, 84, 85, 87, 88, 91, 92, 93, 95, 96, 111, 115, 116, 131, 135; Cl Reactive Orange 5, 7, 10, 11, 12, 13, 15, 16, 20, 30, 34, 35, 41, 42, 44, 45, 46, 56, 57, 62, 63, 64, 67, 69, 71, 72, 73, 74, 78, 82, 84, 87; Cl Reactive Red 3, 3;1, 13, 17, 19, 21, 22, 23, 24, 29, 31, 35, 37, 40, 41, 43, 45, 49, 55, 56, 58, 63, 67, 80, 81, 82, 85, 86, 87, 104, 106, 108, 109, 110, 111, 112, 113, 114, 117, 118, 119, 120, 123, 124, 126, 128, 130, 131, 132, 141, 147, 158, 159, 170, 171, 174, 176; Cl Reactive Blue 2, 3, 5, 8, 10, 13, 14, 15, 17, 18, 19, 21, 25, 26, 27, 28, 29, 38, 39, 40, 42, 43, 49, 51, 52, 65, 66, 67, 68, 71, 73, 74, 75, 77, 78, 79, 80, 89, 98, 100, 101, 104, 105, 112, 113, 114, 116, 119, 147, 148, 158, 160, 162, 169, 170, 171, 179, 182, 187; Cl Reactive Green 5, 8, 12, 14, 15, 16, 19, 21; Cl Reactive Black 4, 5, 8, 14, 21, 23, 26, 31, 32, 34.

Further preferred anionic dyes include Projet Fast Black 2, Pro-Jet Black 1, Pro-Jet Fast Cyan 2, Pro-Jet Cyan 1, Pro-Jet Magenta 1, Pro-Jet Magenta 1T, Pro-Jet Fast Magenta 2, Pro-Jet, Projet Magenta 3B-OA, Pro-Jet Yellow 1, Pro-Jet Yellow 1 G, Pro-Jet Yellow OAM, Pro-Jet Red OAM, Pro-Jet Blue OAM (all of which are available from Zeneca Specialties or its successor) and the dyes disclosed in PCT application number GB97/03423 which are incorporated herein by reference thereto.

The present method enables a wide range of water-soluble anionic dyes to be printed onto a polyamide textile material. Accordingly the water-soluble anionic dyes in the inks used in step ii) can be selected such that the colour gamut of the resulting print is maximised, whilst maintaining a high colour yield and good dye fixation of on the substrate.

A preferred set of inks for use in step ii) of the present method comprises one or more inks selected from:

(a) a black ink comprising a liquid medium and a dye selected from Cl Direct Black 195, Cl Direct Black 168 and Cl Direct Black 19;

(b) a cyan ink comprising a liquid medium and a dye selected from Cl Acid Blue 9, Cl Acid Blue158, Cl Acid blue 90 and Direct Blue 199;

(c) a magenta ink comprising a liquid medium and a dye selected from Cl Acid Red 52, Cl Acid Red 249, Cl Direct Violet 107, Cl Direct Violet 106 and Cl Reactive Red 31;

(d) a yellow ink comprising a liquid medium and a dye selected from Cl Direct Yellow 86, Direct Yellow 132, Direct Yellow 173 Cl Reactive Yellow 85 and Cl Acid Yellow 23; and optionally (e) one or more inks comprising a liquid medium and a dye selected from the dyes of the Formula (1) to (13) described in PCT application number GB97/03423 which is incorporated herein by reference thereto.

Preferably the ink contains from 0.05 to 25 parts, more preferably 0.5 to 20 and especially 2 to 15 parts by weight of the water-soluble anionic dye.

Preferred liquid media include water, a mixture of water and an organic solvent and an organic solvent free from water.

When the medium comprises a mixture of water and an organic solvent, the weight ratio of water to organic solvent is preferably from 99:1 to 1:99, more preferably from 99:1 to 50:50 and especially from 95:5 to 80:20.

It is preferred that the organic solvent present in the mixture of water and organic solvent is a water-miscible organic solvent or a mixture of such solvents. Preferred water-miscible organic solvents include $C_{1-6}$alkanols, preferably methanol, ethanol, n-propanol, isopropanol, n-butanol, sec-butanol, tert-butanol, n-pentanol, cyclopentanol and cyclohexanol; linear amides, preferably diriethylformamide or dimethylacetamide; ketones and ketone-alcohols, preferably acetone, methyl ether ketone, cyclohexanone and diacetone alcohol; water-miscible ethers, preferably tetrahydrofuran and dioxane; diols, preferably diols having from 2 to 12 carbon atoms, for example pentane-1,5-diol, ethylene glycol, propylene glycol, butylene glycol, pentylene glycol, hexylene glycol and thiodiglycol and oligo- and poly-alkyleneglycols, preferably diethylene glycol, triethylene glycol, polyethylene glycol and polypropylene glycol, preferably polyethylene glycol with an average molecular weight of 200, 300 or 400; triols, preferably glycerol and 1,2,6-hexanetriol; mono-$C_{1-4}$-alkyl ethers of diols, preferably mono-$C_{1-4}$-alkyl ethers of diols having 2 to 12 carbon atoms, especially 2-methoxyethanol, 2-(2-methoxyethoxy)ethanol, 2-(2-ethoxyethoxy)-ethanol, 2-[2-(2-methoxyethoxy)ethoxy]ethanol, 2-[2-(2-ethoxyethoxy)-ethoxy]-thanol and ethyleneglycol monoallylether; polyalkoxylated naphthols, preferably those described in EP 555 950 which are incorporated herein by reference thereto, more preferably polyalkoxylated 2-naphthols and especially polyethoxylated 2-naphthols; cyclic amines, preferably optionally substituted morpholine; cyclic amides, preferably 2-pyrrolidone, N-methyl-2-pyrrolidone, N-ethyl-2-pyrrolidone, caprolactam and 1,3-dimethylimidazolidone; cyclic esters, preferably caprolactone; sulphoxides, preferably dimethyl sulphoxide and sulpholane. Preferably the liquid medium comprises water and 2 or more, especially from 2 to 8, water-soluble organic solvents.

Especially preferred water-soluble organic solvents are cyclic amides, especially 2-pyrrolidone, N-methylpyrrolidone and N-ethyl-pyrrolidone; diols, especially 1,5-pentane diol, ethyleneglycol, thiodiglycol, diethyleneglycol and triethyleneglycol; triols, especially glycerol; polyethylene glycols, especially polyethylene glycol 200 and polyethylene glycol 400; mono-$C_{1-4}$-alkyl and $C_{1-4}$-alkyl ethers of diols, more preferably mono-$C_{1-4}$-alkyl ethers of diols having 2 to 12 carbon atoms, especially 2-methoxy-2-ethoxy-2-ethoxyethanol; polyethoxylated 2-naphthol; and compounds of the Formula (3):

Formula (3)

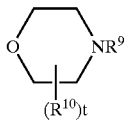

wherein:

$R^9$ and each $R^{10}$ independently is H or optionally substituted alkyl; and t has a value of 1 to 4.

Preferably $R^9$ and each $R^{10}$ independently is H or $C_{1-5}$-alkyl optionally substituted by —OH, —$NH_2$, —$SO_3H$ or —COOH, more preferably H or $C_{1-4}$-alkyl optionally substituted by —OH. It is especially preferred that $R^{10}$ is H and $R^9$ is H or $C_{2-4}$-hydroxy alkyl.

Preferred compounds of Formula (3) include, for example morpholine, 4-(2-hydroxyethyl)morpholine, 4-(3-hydroxypropyl)morpholine and 4-methylmorpholine.

Examples of further suitable ink media comprising a mixture of water and one or more organic solvents are described in U.S. Pat. No. 4,963,189, U.S. Pat. No. 4,703,113, U.S. Pat. No. 4,626,284 and EP, 4,251,50A.

When the liquid medium comprises an organic solvent substantially free from water, (i.e. less than 1% water by weight) the solvent preferably has a boiling point of from 30° to 200° C., more preferably of from 400 to 150° C., especially from 50 to 125° C. The organic solvent may be a water-immiscible solvent, a water-miscible solvent or a mixture of such solvents. Preferred water-miscible organic solvents are any of the hereinbefore described water-miscible organic solvents and mixtures thereof. Preferred water-immiscible solvents include, for example, aliphatic hydrocarbons; esters, preferably ethyl acetate; chlorinated hydrocarbons, preferably $CH_2Cl_2$; and ethers, preferably diethyl ether; and mixtures thereof.

When the liquid medium comprises a water-immiscible organic solvent, preferably a polar solvent is included because this enhances solubility of the dye in the liquid medium. Examples of polar solvents include $C_{1-4}$-alcohols. In view of the foregoing preferences it is especially preferred that where the liquid medium is an organic solvent free from water it comprises a ketone (especially methyl ethyl ketone) and/or an alcohol (especially a $C_{1-4}$-alkanol, more especially ethanol or propanol).

When the liquid medium is an organic solvent substantially free from water it is preferably a mixture of 2 to 5 different organic solvents. This allows a medium to be selected which gives good control over the drying characteristics and storage stability of the ink.

The ink may also contain additional components conventionally used in ink jet printing inks, for example viscosity and surface tension modifiers, corrosion inhibitors, biocides, kogation reducing additives and surfactants which may be ionic or non-ionic.

In a first preferred embodiment of the present method the inks used in stage ii) comprise:

(a) from 0.05 to 30, more preferably from 1 to 15 parts of a water-soluble anionic dye;

(b) from 0.01 to 50, more preferably from 1 to 30 and especially 2 to 10 parts of a compound of the hereinbefore defined Formula (3);

(c) from 0 to 50, more preferably from 0.5 to 25 and especially from 2 to 10 parts of 2-pyrrolidone;

(d) from 0 to 30, more preferably 0 to 20 and especially 2 to 10 parts of one or more compounds selected from glycerol, polyethylene glycol 200, polyethylene glycol 400 or a polyethoxylated 2-naphthol;

(e) from 40 to 99, more preferably from 50 to 95, and especially from 55 to 85 parts water;

wherein all parts are by weight and the sum of the parts (a)+(b)+(c)+(d)+(e)=100.

The inks according to this first preferred embodiment exhibit excellent jetting performance when incorporated into an ink jet printer. The inks are very stable, exhibit minimal crusting and provide high quality prints when used in the present method.

Preferably component (a) of the preferred inks is selected from, Cl Acid Yellow 23, Cl Direct Blue 199, Cl Acid Red 52, CI Acid Blue 158, Cl Acid Blue 9, Cl Direct Black 168 and Cl Reactive Yellow 85 all of which are commercially available from Zeneca Limited.

Preferably component (b) of the preferred inks is morpholine or 4-(2-5 hydroxyethyi)morpholine.

Preferably component (d) of the preferred inks is glycerol.

The inks according to this preferred embodiment are suitable for printing (especially by means of an ink jet printer) onto a wide range of substrates in addition to polyamide textile materials. Suitable additional substrates include cellulosic textile materials, paper, plastic (especially over head projector slides), metal and glass. Especially preferred substrates are polyamide textile materials, cellulosic textile materials (especially cotton), plain paper and treated papers which may have an acid, alkaline or neutral characteristic.

Any ink jet printer may be used in stage ii) of the method according to the fourth aspect of the invention. Preferred ink jet printers are drop on demand (DOD) and continuous printers. In DOD ink jet printing discrete droplets of ink are ejected from a reservoir through a small orifice in response to an electrical recording signal so that the droplets of ink are directed at a substrate. Preferred DOD ink jet printers are piezoelectric ink jetprinting and thermal ink jet printing. In thermal ink jetprinters, programmed pulses of heat are applied to the ink in the reservoir by means of a resistor adjacent to the orifice, during relative movement between the substrate and the reservoir. In piezoelectric ink jet printers the ink is ejected from the orifice through the expansion and contraction of an ink reservoir formed from a piezoelectric material.

In continuous ink jet printers a stream of ink droplets are ejected from a small orifice and electrical fields are used to either direct the droplets towards a substrate or into a gutter for recycling. When a continuous ink jet printing technique is used the ink composition preferably also contains a conducting material such as an ionised salt to enhance and stabilise the charge applied to the ink drops during ejection from the printer head. Suitable salts for this purpose are alkali metal salts of mineral acids.

The heating in step iii) of the method according to the fourth aspect of the invention, to fix the dye to the polyamide textile material, may be performed using any convenient heating method. Preferred heating methods are hot air heating, microwave heating, electron beam heating, steam heating or a combination of steam and microwave heating. Preferably heat is applied in step iii) for a period of up to 60 minutes, this fixes the dye onto the polyamide textile material. When a steam (wet) heat treatment is used, the heating is preferably performed at 100–105° C. for from 5 to 40, more preferably from 10 to 35 minutes. If hot air heating is employed the heating is preferably performed at 140–160° C. for from 2 to 8 minutes.

After step iii) the textile material is preferably washed using a series of hot and cold washes in water and aqueous detergent solutions. Washing removes any unfixed dye and other ingredients of the composition from the printed polyamide textile material.

A preferred washing method comprises the steps:

step (a) a cold wash in an aqueous alkaline medium, preferably at a temperature of from 5 to 30° C.;

step (b) a hot wash in water at a temperature of from 50 to 80, more preferably 55 to 65° C.; and optionally step (c) a cold wash in water containing a fabric softener, preferably at a temperature of from 5 to 30° C.

We have found that this washing method minimises staining of the white undyed portions of the cloth and results in a textile with good handling properties. Good handling properties or "feel" of a material is particularly desirable in delicate fabrics such as silk.

The cold wash in stage (a) is preferably performed in water which contains sufficient alkali to neutralise the acid used in the composition according to the first aspect of the present invention. The desired alkaline conditions may be achieved by adding a suitable alkaline material to water. Preferably the alkaline material is ammonia solution.

An especially preferred stage (a) cold water wash comprises water containing from 0.4 to 0.6g/litre of a 35% aqueous ammonia solution. We have found that wash off solutions which contain less ammonia results in prints which exhibit staining of the un-dyed, portions of the fabric. However, if more ammonia is added the anionic dyes on the fabric surface are neutralised which results in undesirable loss of dye fixation and prints which exhibit a poor colour yield.

Preferably the hot wash in stage (b) contains a suitable soap and/or surfactant to aid removal of unfixed dye from the textile. Preferred soaps are anionic soaps. When a surfactant is used it may be ionic or non ionic or a mixture of ionic and non-ionic surfactants. It is especially preferred that the hot bath used in stage (c) contains from 0.5 to 3, more preferably 0.75 to 2 and especially from 0.8 to 1.5 g/litre of a non-ionic surfactant, for example Sunaptol™ P-Extra, available from ICI.

A preferred fabric softener used in stage (c) of the wash-off procedure is Edunine™CSA, which is commercially available from ICI Ltd. The cold wash in stage (c) preferably contains from 0.5 to 4, more preferably from 1 to 3 g/litre of fabric softener.

According to a fifth aspect of the present invention there is provided a polyamide textile material coloured by means of the method according to the fourth aspect of the present invention.

The invention is further illustrated by the following Examples in which all parts and percentages are by weight unless otherwise stated.

EXAMPLE 1

Ink Formulations

Dye (1)

Dye (1)

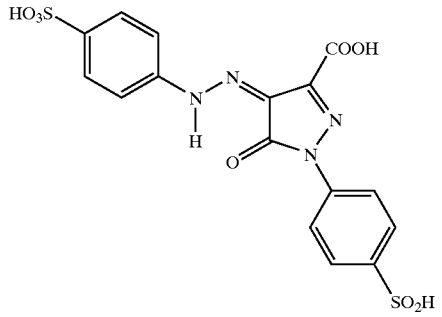

Dye (1) is commercially available as Cl Acid Yellow 23

Dye (2)

Dye (2)

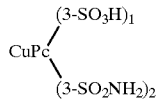

Dye (2) is commercially available as Cl Direct Blue 199

Dye (3)

Dye (3)

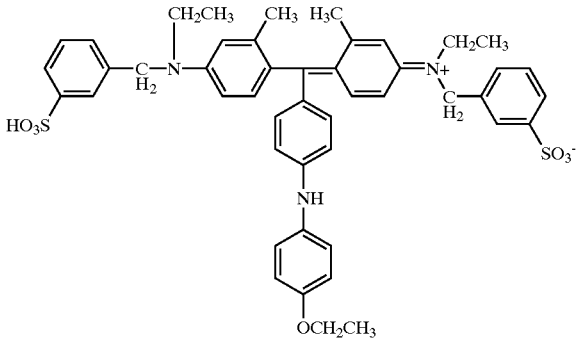

Dye (3) is commercially available as Cl Acid Blue 90

Dye (4)

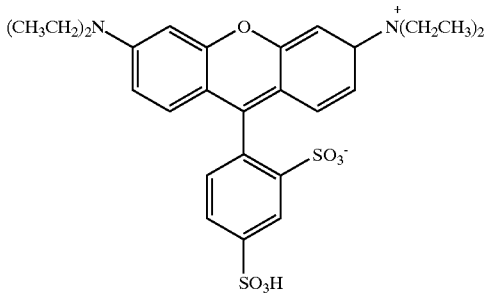

Dye (4) is commercially available as Cl Acid Red 52

Dye (5)

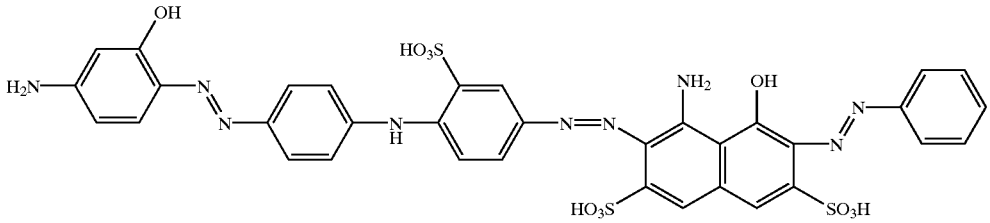

Dye (5) is commercially available as Cl Direct Black 168

Dye (6)

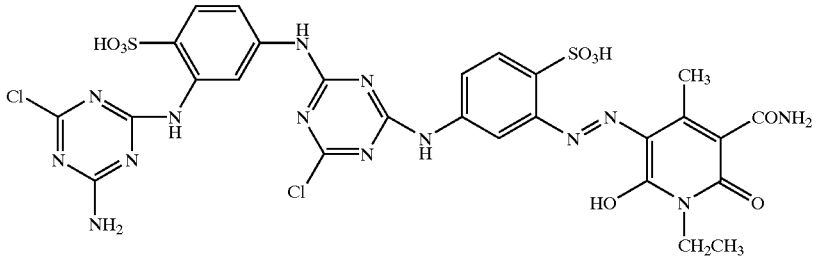

Dye (6) is commercially available as Cl Reactive Yellow 85.

Inks

Ink (1):

5 parts Dye (1);

5 parts 4-(2-hydroxyethyl)morpholine;

90 parts water

Ink (1) was prepared by mixing the above components with stirring. The resulting mixture was then filtered through a 0.45 $\mu$m filter to give the ink. Inks (2) to (6) shown in Table 1 were prepared using an analogous method to that described for Ink (1).

In Table 1 the following abbreviations are used:

| | |
|---|---|
| HEM = | 4-(2-hydroxyethyl)morpholine |
| 2-P = | 2-pyrrolidone |
| GLY = | glycerol |

The column marked "Dye parts" refers to the number of parts by weight of the relevant dye. The numbers in the columns 3 to 6 refer to the number of parts by weight of the relevant formulant shown.

Ink Jet Printing Each of the inks shown in Table 1 was loaded ink into a Stork TCP-20-20 continuous ink jet printer head. The inks were then ejected from the head vertically downwards.

The jetting performance of each ink was assessed by measuring the distance travelled by the ink droplets from the nozzle of the ink jet head before the droplets distorted or fragmented into smaller droplets. A stroboscope was used to view the individual ink droplets and measure the jetting distance visually against a ruled scale. A suitable observation apparatus is described in the proceedings of the IS&T NIP-12 Conference on Digital Printing Technologies 1996, p.38.

In Table 1 the column marked "jetting distance" refers to the distance travelled by an the ink droplets prior to droplet distortion or fragmentation.

TABLE 1

| Ink | Dye | Dye parts | 2-P | HEM | GLY | Water | Jetting Distance (mm) |
|---|---|---|---|---|---|---|---|
| Ink (1) | Dye (1) | 5 | 0 | 5 | 0 | 90 | 14.28 |
| Ink (2) | Dye (2) | 5 | 0 | 5 | 0 | 90 | 13.67 |
| Ink (3) | Dye (3) | 5 | 0 | 5 | 0 | 90 | 13.01 |
| Ink (4) | Dye (4) | 5 | 6 | 3 | 0 | 86 | 11.03 |
| Ink (5) | Dye (5) | 5 | 6 | 3 | 0 | 86 | 11.39 |
| Ink (6) | Dye (6) | 5 | 6 | 3 | 0 | 86 | 17.22 |
| Ink (7) | Dye (5) | 5 | 3 | 6 | | 86 | 11.33 |
| Ink (8) | Dye (5) | 5 | 4.5 | 4.5 | 0 | 86 | 10.70 |
| Ink (9) | Dye (5) | 5 | 3 | 3 | 3 | 86 | 10.69 |
| Ink (10) | Dye (4) | 5 | 3 | 6 | 0 | 86 | 8.91 |
| Ink (11) | Dye (4) | 5 | 4.5 | 4.5 | 0 | 86 | 9.66 |
| Ink (12) | Dye (4) | 5 | 3 | 3 | 3 | 86 | 9.14 |

TABLE 1-continued

| Ink | Dye | Dye parts | 2-P | HEM | GLY | Water | Jetting Distance (mm) |
|---|---|---|---|---|---|---|---|
| Comparative (1) | Dye (4) | 5 | 0 | 0 | 5 | 90 | 6.11 |
| Comparative (2) | Dye (5) | 5 | 0 | 0 | 5 | 90 | 3.60 |
| Comparative (3) | Dye (5) | 5 | 5 | 0 | 0 | 90 | 7.61 |

The further the ink can be jetted without distorting or fragmentation the better the jetting performance of the ink. A high jetting distance is desirable because this reduces the scatter and thus minimises blurring and feathering of the printed image From Table 1 it is clear that the inks according to the first preferred embodiment of the fourth aspect of the present invention (Inks(1) to (12)) exhibit excellent jetting performance compared to Comparative inks (1) to (3).

The inks shown in Table 1 were assessed for dry-out properties by placing 5 g of each ink into a 60 ml open topped sample bottle. Each ink was then left at ambient temperature in the open jars for a period of 72 hours. After this time the mass lost by each ink was calculated. Each of the inks was examined under an optical microscope for evidence of dye crystallisation.

In Table 2 Inks (2), (4), (5) and (6) are the inks described in Table 1. Control (1), (2), (3) and (4) refer to control inks comprising 5 parts of Dye (4), (2), (6) and (5) respectively in 95 parts water.

TABLE 2

| Ink | % weight loss after 72 hours | Dye crystallisation present after 72 hours |
|---|---|---|
| Ink (4) | 48.5 | no |
| Control (1) | 70.2 | yes |
| Ink (2) | 48.0 | no |
| Control (2) | 64.1 | yes |
| Ink (6) | 43.8 | no |
| Control (6) | 64.1 | yes |
| Ink (5) | 44.8 | no |
| Control (5) | 70.6 | yes |

The results in Table 2 clearly show that the inks according to the first preferred embodiment of the method according to the fourth aspect of the present invention exhibit excellent dry-out properties and are stable to storage.

EXAMPLE 2:

Pre-Treatment Composition (PTC-1): (Composition According to the Second Aspect of the Invention)

Stage (a): Preparation

PTC-1 Comprised:

20 parts distearyl dimethylammonium chloride (cationic substance);

15 parts Solvitose WB (hydroxypropylated starch);

0.5 parts citric acid; and 64.5 parts water.

(Solvitose WB is commercially available from Avebe, Holland.)

PTC-1 was prepared by adding the distearyl dimethyammonium chloride, Solvitose WB and citric acid to water at a temperature of 40 to 50° C. The mixture was then stirred until all of the components were in solution.

Stage (b): Application

PTC-1 was applied to Habotai silk (commercially available from Whaleys (Bradford) Ltd) by padding using a Hall and Boyden padder operated at roller speed of 4 rpm and with a pressure of 1 bar applied between the rollers.

The padded silk was then dried at 70° C. for approximately 2 to 3 minutes using a Roaches TFO Series drier.

EXAMPLE 3

Further pre-treatment compositions (PTC-2,-3, 4 and -5)) shown in Table 3 and the Comparative formulations shown in Table 4 were prepared using an analogous method to that described in stage (a) of Example 1. Each of the compositions shown in Tables 3 and 4 was applied to Habotai Silk by padding as described in stage (b) of Example 1.

In Tables 3 and 4 DSDMAC is distearyldimethylammonium chloride.

The pre-treated silk fabrics shown in Tables 3 and 4 were ink jet printed with each of Inks (2), (5), (6) and (4) shown in Table 1 using a Stork TCP-20-20 continuous ink jet printer (i.e. cyan, black, yellow and magenta inks).

After printing each fabric sample was subjected to steam heating at 102° C. for 8 minutes. The fabrics were then washed using steps (a), (b), (c) and (d):

(a) a cold (ambient temperature) rinse in water containing 0.5 g/litre of 35% ammonia solution;

(b) a hot rinse at 60° C. in water containing 1 g/litre of Sunaptol P Extra (a surfactant available from ICI);

(c) a cold rinse in water at ambient temperature; and (d) a cold rinse in water containing 2 g/litre Edunine CSA (a softener) available from ICI.

The colour yield of each print was assessed by reflectance spectrophotometry using the method of Derbyshire and Marshall (J. Society of Dyers and Colourists, volume 96 (1980) page 166) which is based on the Kubelka-Munk equation (Z. Tech. Physik, volume 12 (1931) page 593) and termed the 'Integ' value:

$$Integ = \sum_{400}^{700} I_\lambda \cdot F_\lambda \cdot (\overline{X}_\lambda + \overline{Y}_\lambda + \overline{Z}_\lambda)$$

where $$F_\lambda = \frac{[1-(R_\lambda - R_o)]^2}{2(R_\lambda - R_o)} - \frac{[1-(R_s - R_o)]^2}{2(R_s - R_o)}$$

$R_\lambda$ k reflectance of the print at wavelength $\lambda$ $R_o$ reflectance of the undyed substrate at the same wavelength $R_o$ constant $I_\lambda$ is the spectral energy of illuminant D65 x, y, z are the 10° standard observer data.

The degree of staining on the unprinted parts of the fabric was assessed visually on a scale of 1 to 5, in which 5 equates to no staining and 1 to significant staining of undyed fabric.

The colour yield (Integ) and staining results are shown in Table 5.

TABLE 3

Compositions According to the Second Aspect of the Invention

| Composition | Component (Parts) DSDMAC | Solvitose WB | Citric Acid | Malonic Acid | Succinic Acid | Nicotinic Acid | Sodium Alginate | Water |
|---|---|---|---|---|---|---|---|---|
| PTC-1 | 20 | 15 | 0.5 | 0.5 | | | | 64.5 |
| PTC-2 | 20 | 15 | | 0.5 | | | | 64.5 |
| PTC-3 | 20 | 15 | | | 0.5 | | | 64.5 |
| PTC-4 | 20 | 15 | | | | 0.5 | | 64.5 |
| PTC-5 | 20 | 15 | | | | | 0.5 | 64.5 |

TABLE 4

Comparative Pre-Treatment Compositions

| Composition | Component (Parts) DSDMAC | Solvitose WB | Citric Acid | Malonic Acid | Succinic Acid | Nicotinic Acid | Sodium Alginate | Water |
|---|---|---|---|---|---|---|---|---|
| Comparative 1 | 0 | 15 | 0.5 | | | | | 84.5 |
| Comparative 2 | 20 | 15 | 0 | | | | | 65 |
| Comparative 3 | 20 | 0 | 0.5 | | | | | 79.5 |
| Comparative 4 | 0 | 15 | | 0.5 | | | | 84.5 |
| Comparative 5 | 0 | 15 | | | 0.5 | | | 84.5 |
| Comparative 6 | 0 | 15 | | | | 0.5 | | 84.5 |
| Comparative 7 | 0 | 15 | | | | | 0.5 | 84.5 |

TABLE 5

| Textile sample | Ink | Integ Value (Colour Yield) | Degree of Staining (1–5) |
|---|---|---|---|
| PTC-1 | Ink (6) | 4.92 | 5 |
| | Ink (4) | 13.56 | 5 |
| | Ink (2) | 10.05 | 5 |
| | Ink (5) | 20.97 | 5 |
| Comparative 1 (No DSDMAC) | Ink (6) | 5.05 | 5 |
| | Ink (4) | 12.06 | 3 |
| | Ink (2) | 2.43 | 5 |
| | Ink (5) | 8.93 | 5 |
| Comparative 2 (No acid) | Ink (6) | 4.42 | 3 |
| | Ink (4) | 14.25 | 2–3 |
| | Ink (2) | 6.74 | 4 |
| | Ink (5) | 10.53 | 5 |
| Comparative 3 (No hydroxy propylated starch) | Ink (6) | 2.07 | 5 |
| | Ink (4) | 5.85 | 5 |
| | Ink (2) | 4.34 | 5 |
| | Ink (5) | 8.67 | 5 |
| PTC-2 | Ink (6) | 2.9 | 5 |
| | Ink (4) | 10.7 | 3 |
| | Ink (2) | 8.56 | 5 |
| | Ink (5) | 12.86 | 5 |
| Comparative 4 No DSDMAC | Ink (6) | 3.54 | 5 |
| | Ink (4) | 8.8 | 3 |
| | Ink (2) | 2.99 | 5 |
| | Ink (5) | 12.86 | 5 |
| PTC-3 | Ink (6) | 3.1 | 5 |
| | Ink (4) | 8.22 | 4 |
| | Ink (2) | 9.67 | 5 |
| | Ink (5) | 15.87 | 5 |
| Comparative 5 No DSDMAC | Ink (6) | 3.0 | 5 |
| | Ink (4) | 7.35 | 4 |
| | Ink (2) | 2.21 | 5 |
| | Ink (5) | 10.92 | 5 |
| PTC 4 | Ink (6) | 3.03 | 5 |
| | Ink (4) | 7.02 | 4 |
| | Ink (2) | 9.49 | 5 |
| | Ink (5) | 13.77 | 5 |

TABLE 5-continued

| Textile sample | Ink | Integ Value (Colour Yield) | Degree of Staining (1–5) |
|---|---|---|---|
| Comparative 6 (No DSDMAC) | Ink (6) | 4.02 | 5 |
| | Ink (4) | 1.94 | 2 |
| | Ink (2) | 1.71 | 2 |
| | Ink (5) | 10.23 | 5 |
| PTC 5 | Ink (6) | 4.17 | 5 |
| | Ink (4) | 7.63 | 4 |
| | Ink (2) | 9.83 | 5 |
| | Ink (5) | (4.4) | 5 |
| Comparative 7 (No DSDMAC) | Ink (6) | 4.13 | 5 |
| | Ink (4) | 1.82 | 4 |
| | Ink (2) | 3.95 | 5 |
| | Ink (5) | 11.67 | 5 |

The results in Table 5 clearly show that only those fabrics which have been treated with a pre-treatment composition according to the present invention exhibit a high colour yield for all of the inks (cyan, magenta, yellow and black) in combination with little or no staining of unprinted fabric.

For example, a comparison of PTC-1 with Comparative 3 shows that when the composition containing the Solvitose WB (hydroxypropylated starch) is applied to the silk the resulting print has a high colour yield for all inks compared to the composition without the Solvitose WB.

What is claimed is:

1. An aqueous composition having a pH from 2 to 7 comprising a) a cationic substance of formula 1

Formula 1

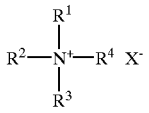

wherein $R^1$, $R^2$ and $R^3$ are each, independently, selected from H, optionally substituted $C_{1-20}$-alkyl and optionally substituted $C_{2-20}$-alkenyl;

$R^4$ is optionally substituted $C_{1-20}$-alkyl or optionally substituted $C_{2-20}$-alkenyl; and X is an anion;

b) an inorganic or organic acid; and c) an alkyl or hydroxyalkyl substituted starch.

2. An aqueous composition as claimed in claim 1 having a pH from 3.5 to 5.5.

3. An aqueous composition as claimed in either claim 1 or claim 2 wherein the cationic substanoe is a distearyldimetnylammonium salt.

4. An aqueous composition as claimed in claim 1 wherein the acid is selected from nicotinic, citric, tartaric and malonic acids.

5. An aqueous composition as claimed in claim 1 comprising:

from 0.5 to 99.5 parts of component (a);

from 0.1 to 60 parts of component (b); and from 0.1 to 99.5 parts of component (c);

wherein all parts are by weight and the sum of the parts of component (a)+(b)+(c)=100.

6. An aqueous compostion as claimed in claim 1 wherein component (c) is a $C_{1-8}$-alkyl substituted starch or a $C_{2-4}$-hydroxyalkyl substituted starch.

7. An aqueous compositon as claimed in claim 1 wherein component (c) is hydroxypropyl substituted tapioca starch.

8. A polyamide textile material treated with a composition as claimed in claim 1.

9. A method for the coloration of a polyamide textile material comprising the steps:

i) treating the polyamide textile material with a composition as claimed in claim 1;

ii) applying by means of an ink jet printer an ink composition comprising a liquid medium and water-soluble anionic dye, or a salt thereof, to the product of step i); and iii) heating the product of step ii) at a temperature of from 50° C. to 250° C.

10. A method as claimed in claim 9 wherein the ink comprises:

(a) from 0.05 to 30 parts of a water-soluble anionic dye;

(b) from 0.01 to 50 parts of a compound of the Formula (3):

Formula (3)

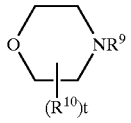

wherein:

$R^8$ and each $R^{10}$ independenty, is H or optionally substituted alkyl; and t has a value of 1 to 4;

(c) from 0 to 50 parts of 2-pyrrolidone;

(d) from 0 to 30 parts of one or more compounds selected from glycerol, polyethylene glycol 200, polyethylene glycol 400 or a polyethoxylated 2-naphthol; and (e) from 40 to 99 parts water;

wherein all parts are by weight and the sum of the parts (a)+(b)+(c)+(d)+(e)=100.

11. A method as claimed in claim 10 wherein $R^{10}$ is H and $R^8$ is H or $C_{2-4}$-hydroxyalkyl.

12. A method as claimed in claim 9 wherein the ink is selected from one or more inks comprising:

(a) a black ink comprising a liquid medium and a dye selected from Cl Direct Black 195, Cl Direct Black 168 and Cl Direct Black 19;

(b) a cyan ink comprising a liquid medium and a dye selected from Cl Acid Blue 9, Cl Acid Blue 158, Cl Acid Blue 90 and Directed Blue 199;

(c) a magenta ink comprising a liquid medium and a dye selected from Cl Acid Red 52, Cl Acid Red 249, Cl Direct Violet 107, Cl Direct Violet 106 and Cl Reactive Red 31; and (d) a yellow ink comprising a liquid medium and a dye selected from Cl Direct Yellow 86, Direct Yellow 132, Direct Yellow 173, Cl Reactive Yellow 85 and Cl Acid Yellow 23.

13. A method as claimed in claim 9 wherein the product of step iii) is subjected to a washing method comprising the steps:

step (a) a cold wash in an aqueous alkaline medium;

step (b) a hot wash in water at a temperature of from 50 to 80° C.; and optionally step (c) a cold wash in water containing a fabric softener.

14. A polyamide textile material coloured by means of the process as claimed in claim 9.

* * * * *